US006149503A

United States Patent [19]

Laycock

[11] Patent Number: 6,149,503

[45] **Date of Patent: *Nov. 21, 2000**

[54] METHOD AND APPARATUS FOR SUPPORTING A CRANKSHAFT IN A GRINDING MACHINE FOR GRINDING THE CRANKPINS OF THE CRANKSHAFT

[75] Inventor: Michael Laycock, Keighley, United Kingdom

[73] Assignee: Unova UK Limited, Aylesbury, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/973,417

[22] PCT Filed: Jun. 19, 1996

[86] PCT No.: PCT/GB96/01494

§ 371 Date: Nov. 14, 1997

§ 102(e) Date: Nov. 14, 1997

[87] PCT Pub. No.: WO97/00755

PCT Pub. Date: Jan. 9, 1997

[30] Foreign Application Priority Data

Jun. 23, 1995 [GB] United Kingdom ..... 9512847
Jan. 13, 1996 [GB] United Kingdom ..... 9600708

[51] Int. Cl.[7] ..... B24B 1/00; B24B 5/00

[52] U.S. Cl. ..... 451/49; 451/62; 451/251; 451/399

[58] Field of Search ..... 451/49, 62, 246, 451/251, 385, 399

[56] References Cited

U.S. PATENT DOCUMENTS

| | | | |
|---|---|---|---|
| 1,304,799 | 5/1919 | Norton | 451/399 X |
| 2,161,206 | 6/1939 | Silven | 451/399 |
| 2,600,824 | 6/1952 | Zwick | 451/399 |
| 3,142,941 | 8/1964 | Fournier et al. | 451/399 X |
| 3,145,513 | 8/1964 | Porath . | |
| 3,334,449 | 8/1967 | Price . | |
| 3,537,215 | 11/1970 | Metz et al. | 451/399 |
| 3,769,761 | 11/1973 | Ohsima | 451/399 |
| 4,003,721 | 1/1977 | Price et al. . | |
| 4,023,937 | 5/1977 | Smith . | |
| 4,269,001 | 5/1981 | Bottomley . | |

FOREIGN PATENT DOCUMENTS

| | | | |
|---|---|---|---|
| 1502551 | 6/1969 | Germany . | |
| 1521568 | 11/1989 | U.S.S.R. | 451/399 |
| 2 110 577 | 6/1983 | United Kingdom . | |

*Primary Examiner*—Timothy V. Eley
*Attorney, Agent, or Firm*—Lee, Mann, Smith, McWilliams, Sweeney & Ohlson

[57] ABSTRACT

A method of supporting a workpiece having journal and eccentric regions, in a grinding machine for grinding the eccentric regions thereof, is described which involves mounting the workpiece in a headstock of the grinding machine, providing a coupling between the workpiece and a rotary drive mechanism for rotating the workpiece about its main axis and fitting around at least one remote journal region of the workpiece a pair of members which form a journal bearing complementary to the said region, and fixing the lower of the two members to the machine, thereby providing support for the workpiece at the said remote position. The method is particularly relevant to the grinding of crankpins of a crankshaft. A grinding machine for grinding the crankpins of a crankshaft workpiece comprises headstock means mounted on the machine bed, a grinding wheel mounted on a wheelhead assembly, drive means for moving the wheelhead towards and away from a workpiece when fitted to the headstock, drive means for rotating a workpiece when mounted in the headstock, and two part cradle means mounted in the machine at least one part of which presents at least an upwardly directed curved support surface for engaging the underside of a journal bearing region of a crankshaft workpiece when fitted to the headstock.

32 Claims, 7 Drawing Sheets

METHOD AND APPARATUS FOR SUPPORTING A CRANKSHAFT IN A GRINDING MACHINE FOR GRINDING THE CRANKPINS OF THE CRANKSHAFT

FIELD OF INVENTION

This invention concerns crankpin grinding machines and in particular apparatus and methods for supporting crankshafts in such machines for grinding of the crankpins around the crankshaft.

BACKGROUND TO THE INVENTION

In the grinding of crankpins, drive is transmitted to the crankshaft in conventional manner from the headstock and as the crankshaft rotates so a grinding wheel mounted on a wheelhead is advanced in registry with first one and then another of the crankpins so as to grind the crankpin. The wheelhead is advanced and retracted during rotation of the crankshaft so as to maintain grinding contact between the grinding wheel and the crankpin as the latter is rotated eccentrically around the axis of rotation of the crankshaft.

It has been proposed to use end journals to assist in mounting a crankshaft for grinding of crankpins.

Since the circularity of the crankpins will determine the wear characteristics of the crankshaft and the big end bearings associated therewith, it is highly desirable that whatever method of mounting is employed, it should maintain the highest possible accuracy as regards circularity of grinding surfaces of the crankpins. It has been found that whip, and distortion of the crankshaft during grinding may introduce errors in the circularity of the ground surfaces of the crankpins, resulting in accelerated wear and unreliability of crankshafts ground in this manner.

Conventionally when mounted in an engine block, a crankshaft is supported by journal bearings at opposite ends and at intervals along its length. Typically a journal bearing is provided intermediate each crankpin, so that every part of the crankshaft is supported in a journal bearing. Thus a four cylinder engine will typically have five journal bearings for the crankshaft and a six cylinder engine could have as many as seven crankshaft journal bearings.

It is an object of the present invention to provide an improved method and apparatus for mounting such crankshafts in a crankpin grinder to facilitate the grinding of crankpins thereon in a manner which will reduce the circularity errors characteristic of prior art methods, and apparatus for supporting crankshafts in such machines.

SUMMARY OF THE INVENTION

According to one aspect of the invention, a method of supporting a workpiece having journal and eccentric regions, in a grinding machine for grinding the eccentric regions thereof, comprises the steps of:

i) mounting the workpiece in a headstock of the grinding machine, ii) providing a coupling between the workpiece and a rotary drive mechanism for rotating the workpiece about its main axis (ie the axis of the journal regions thereof); and iii) fitting around a journal region of the workpiece remote from the headstock, a pair of members which cooperate to form at least part of a journal bearing, complementary to the said region, and supporting at least one of the said two members, thereby in turn providing support for the workpiece at the said position remote from the headstock.

The workpiece may be a crankshaft in which event the remote support may be provided by a plurality of said complementary journal bearings, each situated at, and each surrounding, a respective journal bearing region of the crankshaft.

Preferably a lower one of the two members of the or each complementary support bearing is movable into a position in which it is aligned with the crankshaft, and includes an upwardly open curved surface which is of complementary radius to, and in its aligned position cradles the underside of, a journal region of the crankshaft when the latter is fitted to the headstock.

Preferably the other (upper) member of the or each complementary support bearing comprises a closure which is movable between an open position to allow for insertion and removal of a crankshaft, and a closed position in which it bridges the upwardly open cradle so as to restrain movement of the crankshaft in an upward sense out of the cradle provided by the lower member.

The or each closure for bridging the cradle may comprise a finger which when urged towards the crankshaft provides a reaction surface to prevent the said upward movement of the crankshaft.

Alternatively the or each cradle closure may include a downwardly facing curved surface complementary to, and adapted to cooperate with the or each upwardly open curved surface to form at least part of a two part journal bearing around a journal region of the crankshaft, and the method includes the step of moving the or each said closure into contact with the crankshaft, so that the two curved surfaces encircle a journal region and provide a substantially uniform restraint around the circumference thereof.

After grinding the crankpins the or each closure may be raised into its open position so as to be clear of the crankshaft, to permit the latter to be removed, and replaced by a further crankshaft ready for grinding.

During the grinding of the crankpins, the closure may be secured to the cradle and the method further comprises the step of releasing the closure from the cradle after grinding.

The method may include the step of forcing fluid between at least the curved cradle support surface and the journal surface of the crankshaft, during rotation thereof.

The fluid may be a gas or mixture of gases.

Alternatively both cradle and closure curved surfaces are apertured and a hydrostatic bearing is formed with the crankshaft when fluid is pumped between the two bearing surfaces and the crankshaft. In this case the fluid will normally be a liquid, and typically may be oil based.

Preferably pressures are created such that the hydrostatic forces generated by the liquid are sufficient to centre the or each journal region of the crankshaft so as to minimise the effect of any deformities or misalignment of or surface irregularities in the or each curved surface of the cradle and closure.

Liquid which escapes from between the two surfaces is preferably recovered, cleaned and recycled.

The liquid may comprise a coolant oil as employed in a grinding machine to cool the grinding wheel and workpiece during grinding.

The method may also include the step of mounting the end of the workpiece remote from the headstock, in a tailstock.

According to another aspect of the invention, apparatus for supporting a crankshaft in a grinding machine for grinding the crankpins thereof, in which the crankshaft is carried at one end by a headstock and is rotatable by drive means about its major axis, comprises a two part combination, at least one part of which is securable to the machine, and in which the two parts are positionable relative to the machine and are adapted to be fitted around and at least in part encircle one of the journal bearing regions of the crankshaft, to provide support. therefor remote from the headstock.

The invention also lies in a grinding machine for grinding the crankpins of a crankshaft workpiece, comprising:

i) a machine bed;

ii) headstock means mounted on the bed:

iii) a grinding wheel mounted on a wheelhead assembly;

iv) drive means for moving the wheelhead towards and away from a workpiece when fitted to the headstock;

v) drive means for rotating a workpiece when mounted in the headstock, and vi) two part cradle means mounted in the machine at least one part of which presents at least an upwardly directed curved support surface for engaging the underside of a journal bearing region of a crankshaft workpiece when fitted to the headstock.

The other part of the cradle means may cooperate with the said one part to circumferentially encircle the journal bearing region of a crankshaft workpiece when fitted, and the two parts are movable relatively away from one another, to permit their separation to allow a workpiece to be inserted or removed, and are likewise movable relatively towards each other to circumscribe a workpiece journal bearing region, when inserted therebetween.

A plurality of said two part cradle means may be axially spaced along the workpiece-occupying region of the machine, so as to align with, and provide full circumferential support to, a corresponding plurality of journal bearing regions of a crankshaft workpiece when fitted.

The or each cradle means may include ports through which liquid can be supplied, to form a liquid film between the workpiece (when fitted), and the or each curved surface of the cradle means.

The ports may communicate with a system for supplying liquid under pressure thereto during use, such that the liquid forms a hydrostatic bearing film between the curved surfaces of the cradle means and a crankshaft workpiece when fitted, and the machine includes a fluid collection system to recover fluid which escapes therefrom during rotation of the parts during machining.

Where each journal region of a crankshaft workpiece also includes ports for lubricating oil for when it is mounted in an engine block, the inter-port spacing and positioning of the ports in the curved surfaces of the cradle means is preferably selected so that at no time will pairs of ports in the cradle means coincide with pairs of ports in the crankshaft as the latter rotates, so that the crankshaft ports do not interfere with the establishment of the film of liquid.

The or each cradle means may comprise a lower member aligned with the workpiece occupying region of the machine and fixed relative to the machine bed, having a semi-cylindrical recess formed therein for embracing the lower half of a journal bearing region of the camshaft workpiece when mounted in the machine, and an upper member which is adapted to engage the upper half of the journal bearing region in general alignment with the lower member, the upper member being movable away from the lower member, to allow a workpiece to be placed in and removed from the lower member, and movable towards and adapted to be clamped to, the lower member, to encircle a workpiece therein.

The upper member also may be formed with a semi-cylindrical recess to embrace the upper half of the journal bearing region of the crankshaft when fitted, and the upper and lower members are adapted to be secured together, as by clamping, to form a continuous sleeve therearound.

Drive means may be provided for effecting the said movement of the upper member, which drive means is, in use, controlled by an overall control system linked to or forming part of the machine, so that the two members of the or each cradle means are separated when grinding is completed to allow a finished workpiece to be removed and a fresh one to be inserted, and are automatically closed so as to circumscribe the journal bearing region of a new workpiece, after insertion, before grinding commences.

The drive means may comprise a common shaft connected to the respective upper member of each cradle means, wherein rotation of the said common shaft causes simultaneous movement of all the said upper members. The common shaft typically extends through the said upper members and carries splines engageable with respective correspondingly splined bores in the said upper members.

The drive means for rotating the shaft preferably comprises a rotary hydraulic cylinder or electric motor.

The or each cradle means may be slidable relative to the machine bed and includes clamping means for clamping the cradle means thereto.

The machine may include a tailstock for optionally supporting the end of a workpiece remote from that which is fitted in the headstock.

The invention also lies in a cradle assembly for supporting a cylindrical journal region of a workpiece while the latter is being machined comprising a lower part adapted to be secured to a fixed part of a machine and shaped to receive the lower half of the said region, and an upper part movable relative to the lower part, on the one hand to enclose the said region and capture the cylindrical journal region of a workpiece before and during machining and on the other hand to expose the said lower part to enable machined workpieces to be removed and inserted.

The invention also lies in a workpiece when machined in accordance with the methods, or machined on machines, as aforesaid.

In the case of a two cylinder engine crankshaft, the crankshaft will typically include a single central journal bearing in addition to the two end journal bearings. By supporting such a crankshaft midway of its length, so any whip or distortion during crankpin grinding will be reduced.

In the case of a three cylinder engine crankshaft, the crankshaft may include two journal bearings located along its length between the end journal bearings and by supporting such a crankshaft at both said intermediate journal bearing positions, again whip and distortion is reduced.

In the case of a four cylinder engine crankshaft, three intermediate journal bearings may be located along the length of the crankshaft between the journal bearings at opposite ends thereof, and the three bearings supporting the crankshaft serves to reduce whip and distortion and inaccuracy during grinding to a minimum.

Five and six cylinder engine crankshafts may include six or seven journal bearings and to this end supporting these shafts at each of the journal bearing positions will likewise render the crankshaft relatively rigid and reduce whip and distortion and error during grinding to a minimum.

Where the net force acting on the crankpin, due to the interaction between the pin and the grinding wheel, tends to, force the crankshaft in a generally downward direction, it is envisaged that a simple cradle-like member which is adapted to receive as a running fit an intermediate journal bearing of a crankshaft, may be all that is required to provide the necessary support.

Where the support comprises upper and lower jaws these may be pivotally joined for hinging about an axis spaced from and parallel to the main axis of the crankshaft. Drive means may be provided for rotating one or both of the said jaws together and apart to permit entry and exit of crankshafts.

The rotational drive to the crankshaft is preferably decoupled using a decoupling device such as described in UK Patent Applications 9410682.0, 9424139.5 and 9508005.7.

The cradle means may be formed from cast iron, hardened steel, or bronze and may include ports through which lubrication fluid can be forced, preferably hydrostatic fluid which forms a liquid film between the journal bearing surface of the workpiece and the surrounding bearing surfaces of the cradle support means.

The two parts of the cradle bearing support means may be similar, and each may embrace one half of the cylindrical section of a journal bearing section of a workpiece, and the two parts are adapted to be secured together to form a continuous sleeve around the journal bearing section of the workpiece.

Preferably means for supplying fluid under pressure to one or both of two cradle bearing support members is also controlled so that the fluid is only supplied thereto under pressure when the two parts have been moved towards one another so as to circumscribe the journal bearing section of the workpiece, and the workpiece is being rotated.

The methods and apparatus described herein are applicable to any type of grinding process or grinding machine including CNC grinding machines.

BRIEF DESCRIPTION OF THE DRAWINGS

The invention will now be described by way of example with reference to the accompanying drawings in which.

DETAILED DESCRIPTION OF DRAWINGS

Figure 1:
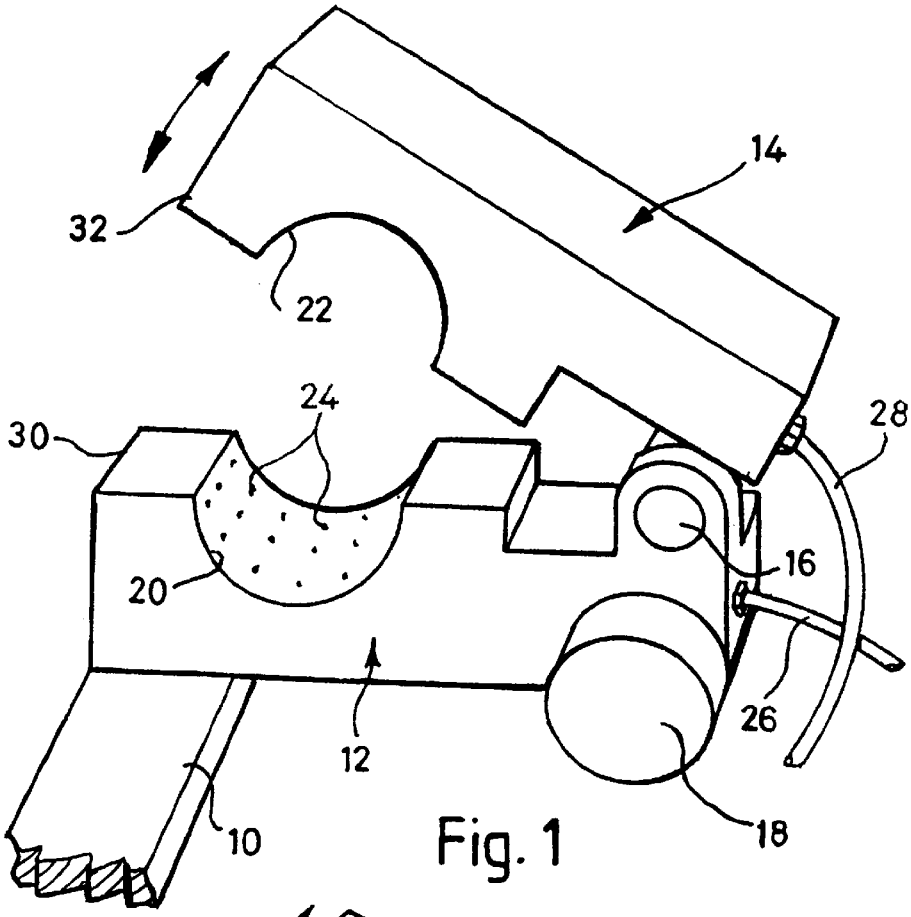
FIG. 1 is a perspective side view of one embodiment of a journal bearing support device in accordance with the invention.

In FIG. 1 a cradle support clamp is shown mounted on one part of a grinding machine bed 10 and comprising a lower jaw 12 and a pivotal upper jaw 14. A hinge joint 16 is provided between jaws 12 and 14, and a drive means 18 is provided for rotating upper jaw 14 relative to lower jaw 12. Typically the drive means 18 is a hydraulic or electric motor.

Formed in each of the two jaws 12 and 14 are complementary semi-cylindrical cavities 20 and 22 respectively which co-operate to form a cylindrical sleeve when the two members 12 and 14 are closed. This is achieved by rotating the upper member 14 at the hinge joint 16 in an anticlockwise manner as shown.

By locating an assembly formed by jaws 12 and 14 at appropriate points along a machine bed such that each of the cylindrical sleeves formed by the cavities 20 and 22 registers with a respective journal bearing section of a crankshaft mounted on the machine between headstock and tailstock (not shown) also mounted on the machine bed 10, so the crankshaft can be supported reliably at intervals along its length, thereby reducing whip and distortion during grinding of the crankpins which are located along the length of the crankshaft intermediate the journal bearing region thereof.

As denoted by reference numeral 24, one or both of the surfaces of the cavities 20 and 22 may be formed with small apertures or ports through which a suitable hydraulic fluid can be forced under pressure when the two jaws 12 and 14 have been closed.

To this end hydraulic fluid pipelines are shown at 26 and 28 for supplying hydraulic fluid under pressure to galleries in each of the two jaws 12 and 14 respectively for supplying the hydraulic fluid to the apertures 24.

Although not shown, clamping means may be provided for securing the outer ends of the two jaws, denoted by reference numerals 30 and 31 respectively, so as to retain the jaws in their clamped closed condition during grinding.

After the crankpins of a crankshaft have been ground, each of the jaws 14 of each of the separate pairs of jaws along the length of the crankshaft is released and rotated in a clockwise manner into a position substantially as shown in FIG. 1 to allow the crankshaft to be removed and a fresh crankshaft placed in position.

Figure 2:
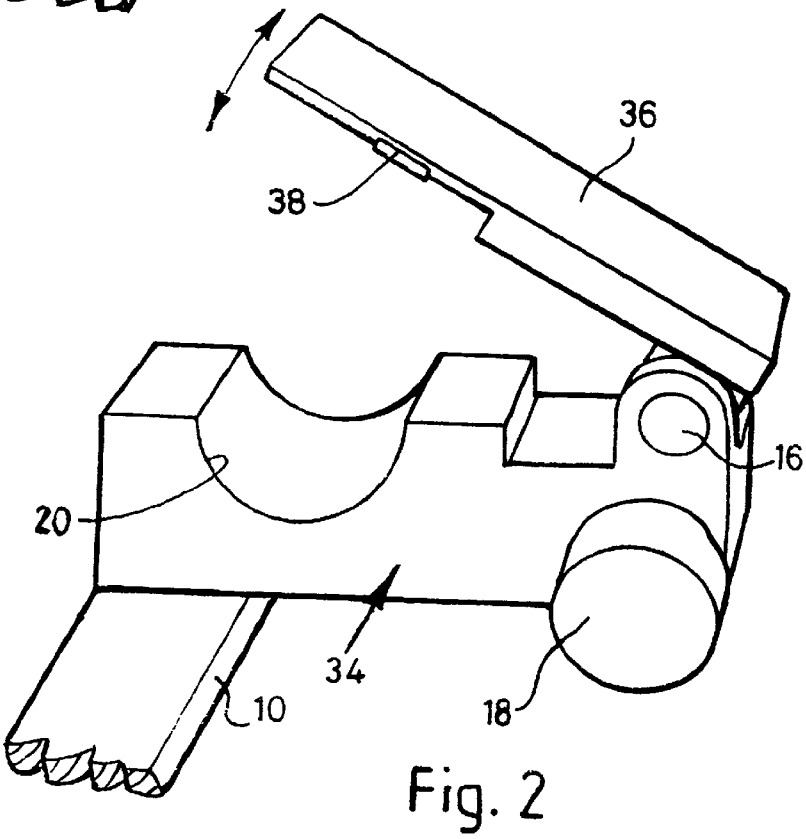
FIG. 2 is a similar view of another embodiment of a journal bearing support device in accordance with the invention.

An alternative arrangement is shown in FIG. 2. Here each of the crankshaft journal bearing supports is formed by a lower member 34, similar to the jaw 12 of FIG. 1 which includes the semi-cylindrical cavity 20, the drive 18 and a hinge pivot 16 which, instead of carrying the member 14 of FIG. 1, carries a reduced mass member 36; the latter includes at an appropriate position along its length a wear member 38 which is adapted to just engage the upper region of a cylindrical journal bearing section of a crankshaft laid so as to rest in the semi-cylindrical cavity 20 of the lower member 34. Although again not shown, means is provided for clamping the upper member 36 in a position such that it holds the crankshaft with the wear member 38 firmly engaging the journal bearing section of the crankshaft during grinding.

As previously, the lower member 34 is secured to a machine bed part of which is shown at 10, and headstock and tailstock means are provided (not shown) for supporting the crankshaft: therebetween.

In each of FIGS. 1 and 2, the jaw assemblies 12 and 14 and 34 and 36 may be removable from the machine bed and may be located at different positions along the length of the machine bed between the headstock and tailstock of the machine so as to accommodate different designs of crankshaft and/or to allow the machine to be initially set up to accommodate a particular crankshaft.

Although not shown, apertures 24 as shown in FIG. 1 may again be provided in the surface of the semi-cylindrical cavity 20, and hydraulic fluid may be supplied thereto under pressure when the crankshaft is in position so as to form part of a hydrostatic bearing.

Alternatively the jaw 34, or at least the surface of the cavity 20, is formed from a hard wearing bearing material.

Figure 3:
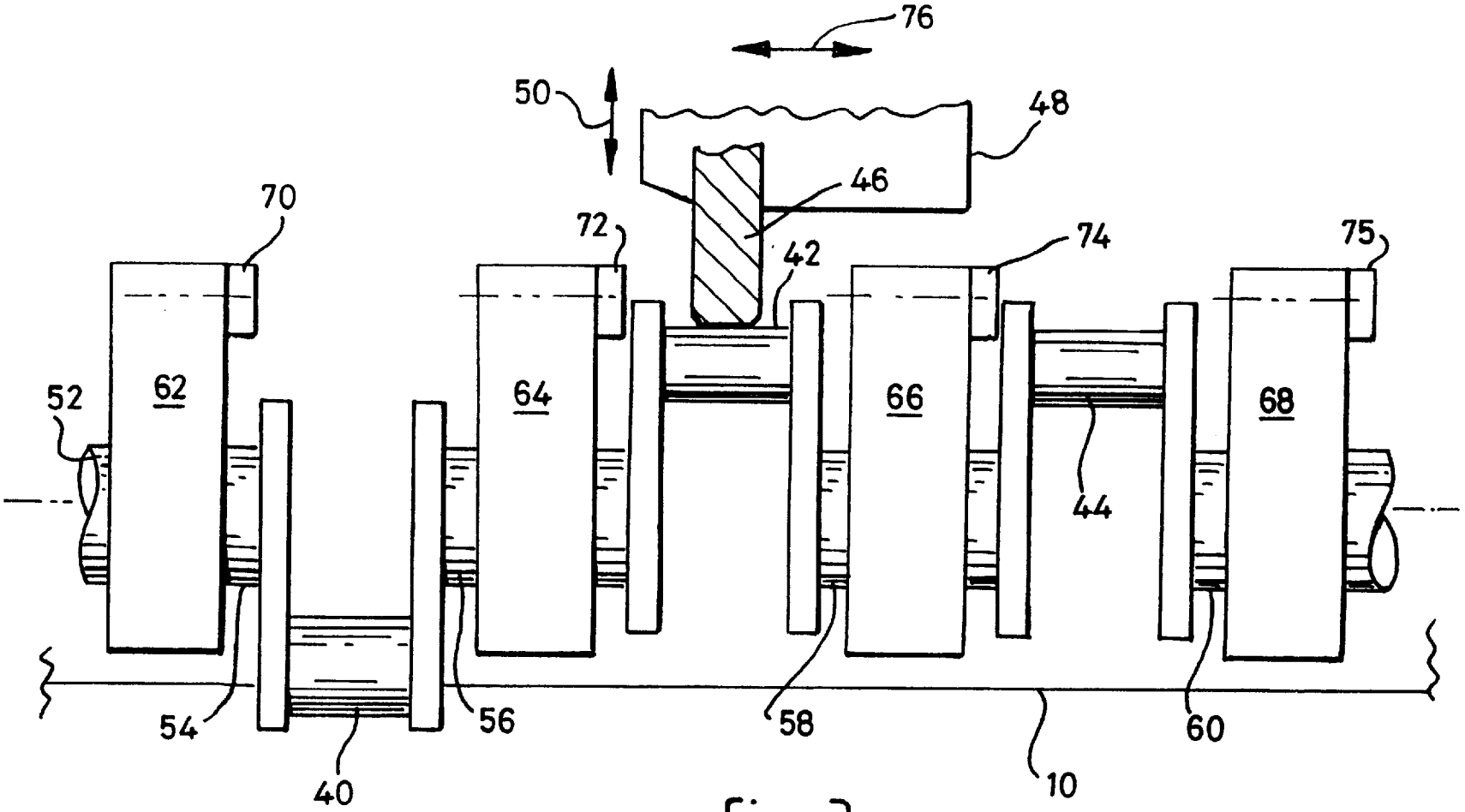
FIG. 3 is a plan view of part of a grinding machine showing how a crankshaft is supported between headstock and tailstock for CNC grinding of the crankpins bearing supports such as shown in FIG. 1.

FIG. 3 is a plan view of part of a machine in which the machine bed is denoted by reference numeral 10 and shows part of a crankshaft located on the machine between headstock and tailstock (not shown) so as to extend parallel to the machine bed 10 to enable crankpins, denoted by reference numerals 40, 42 and 44, to be ground. The machine includes a grinding wheel 46 carried by a wheel head assembly, part of which is shown at 48, and which is movable towards and away from the axis of the crankshaft, as denoted by arrow 50. During grinding the wheelhead assembly 48 is moved both forwards and backwards, so as to follow the locus of the crankpin which is being ground as the latter rotates eccentrically about the main axis of rotation of the crankshaft denoted by reference numeral 52.

Drive to the crankshaft is provided normally from the headstock end and a suitable decoupling driving means may be provided as previously described herein.

Between each of the crankpin eccentrics is a journal bearing section of the crankshaft and in FIG. 3 these are denoted by reference numerals 54, 56, 58 and 60. Each of the journal bearing sections is supported by a pair of jaws, such as 12 and 14 shown in FIG. 1, there being four such jaw assemblies shown in FIG. 3 denoted by reference numerals 62, 64, 66 and 68 respectively. Each assembly includes a separate drive denoted by reference numerals 70, 72, 74 and 75. Hydrostatic bearings are formed between each pair of jaws and the respective journal bearing region of the crankshaft, by supplying hydraulic fluid under pressure by suitable pipes and galleries to apertures in the co-operating surfaces of the jaws, as described with reference to FIG. 1.

Where the width of the grinding wheel 46 is less than the axial length of a crankpin (as is shown in FIG. 3 for crankpin 42), the wheelhead assembly is also adapted for movement along an axis denoted by the arrow 76 which is parallel to the main axis 52 of the crankshaft, so that the grinding wheel 46 can be made to traverse from one end of the crank pin to the other during the grinding process.

Figure 4:
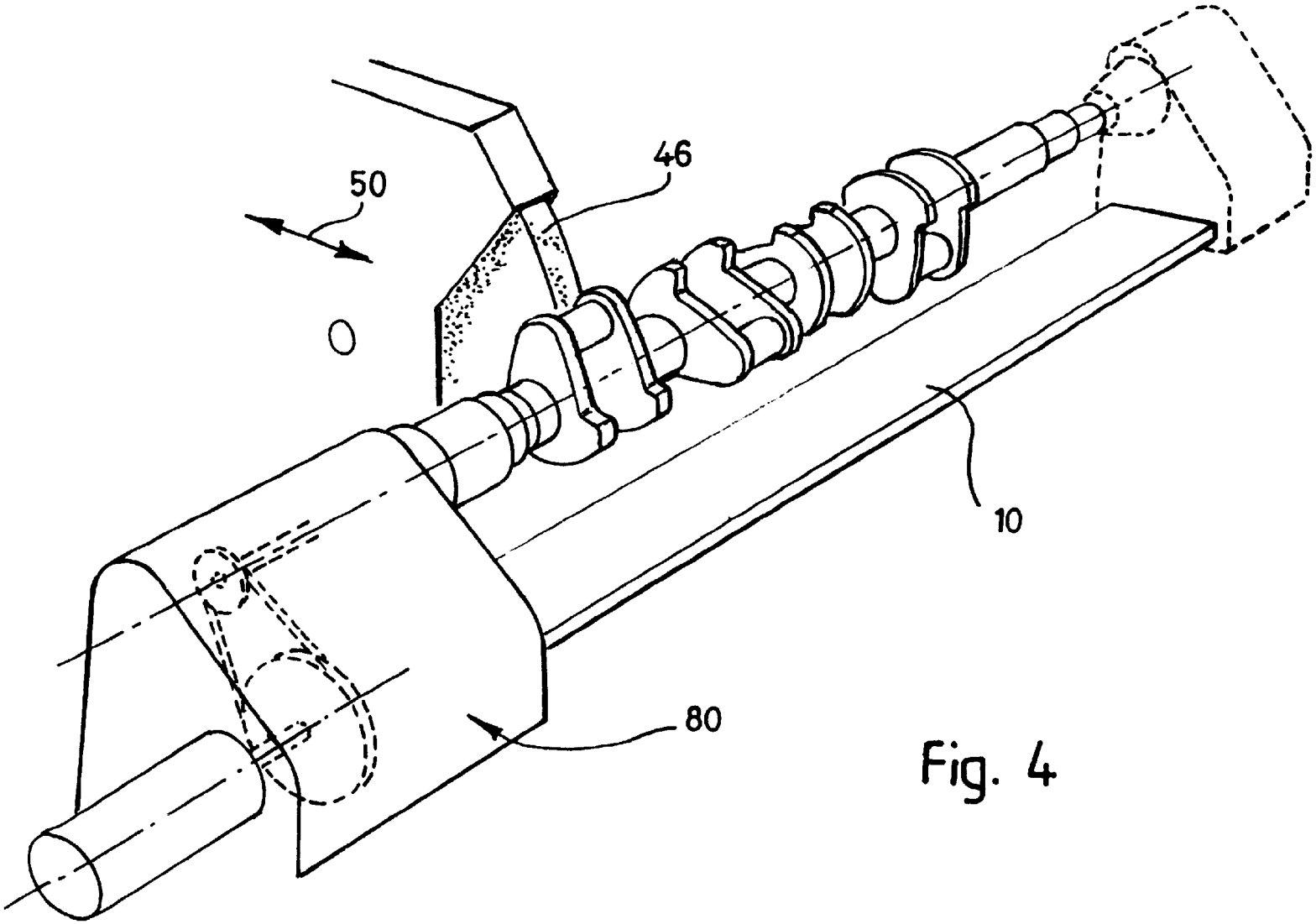
FIG. 4 is a perspective view of part of a grinding machine showing the headstock drive and the X-axis movement of the grinding wheel.

Shown in FIG. 4 is a perspective view of the crankshaft and grinding machine of FIG. 3, though with the supporting jaw assemblies and tailstock omitted. A headstock, shown generally at 80, includes a decoupling device for decoupling the transmitted drive from the headstock to the crankshaft, as above described.

Figure 5:
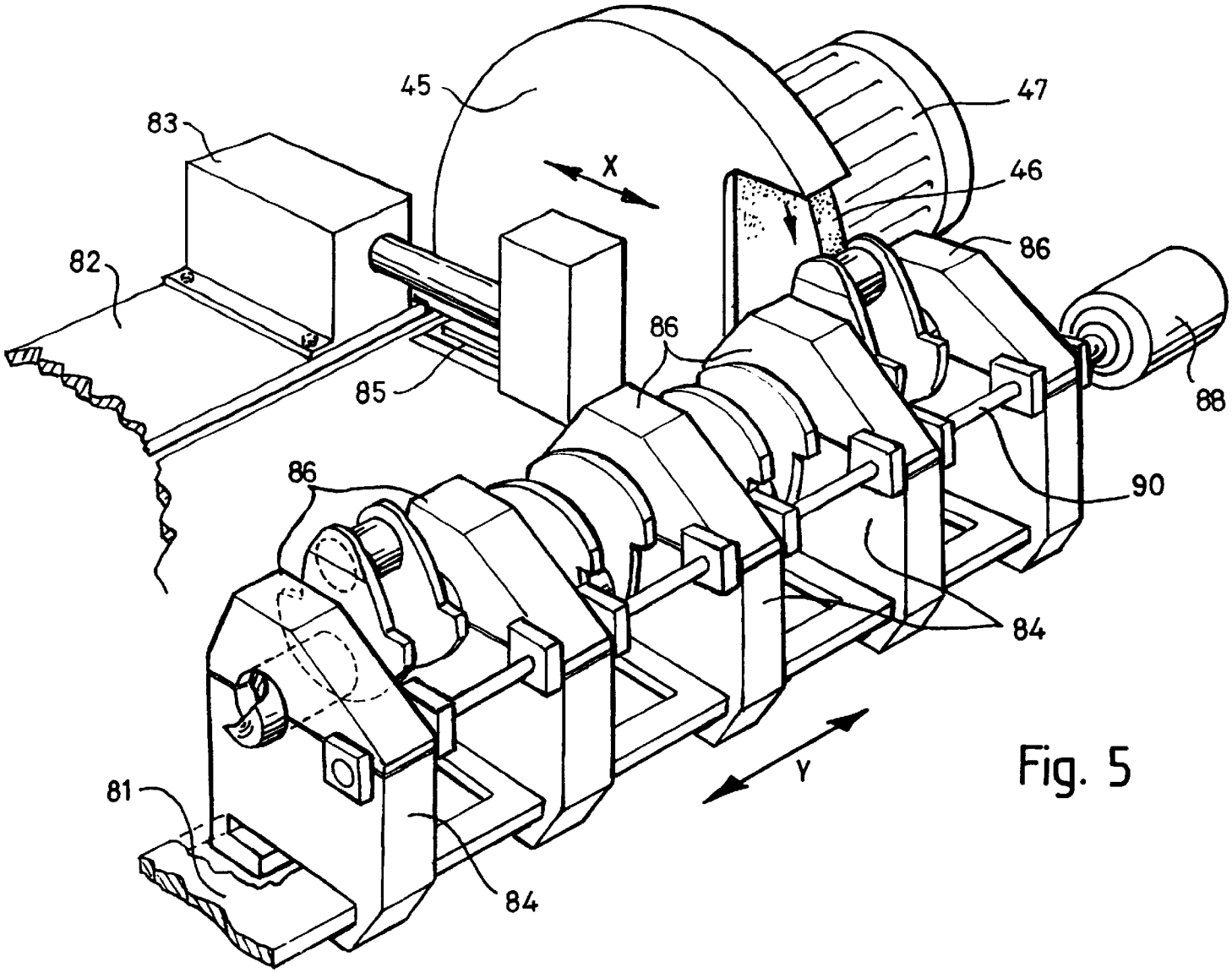
FIG. 5 is a view similar to FIG. 4, but showing the crankshaft supported by journal bearing supports in accordance with the invention.
Figure 6:
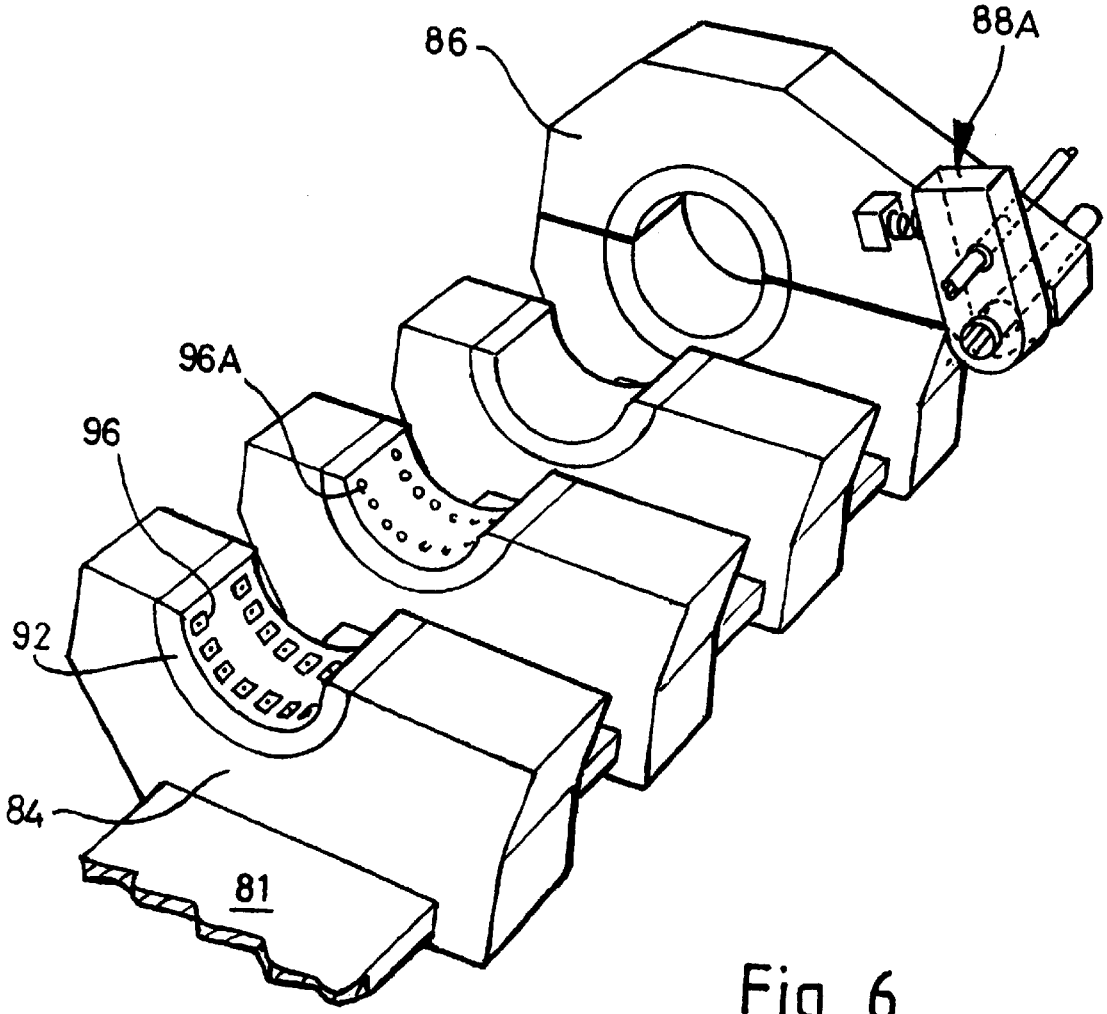
FIG. 6 is a detailed view, again in perspective, of the lubrication ports (or some of the ports for creating a hydrostatic bearing) in the lower support members of the support devices.

Referring now to FIGS. 5 and 6, there is shown a workpiece slideway 81 forming part of a machine bed 82, on which slideway are slidably mounted and locked in position a series of supporting jaw assemblies, each similar to the arrangement of FIG. 1 and each comprising a lower jaw 84 and an upper jaw or cap 86. The grinding wheel 46 is shielded by cover 45 and driven in rotation by a motor 47, carried on the wheelhead.

There are two major movements of the grinding machine: (1) the in-feed movement of the wheelhead along the X-axis achieved by a hydraulic drive 83 and defined by a slideway 85 on which the wheelhead slides towards and away from the workpiece, and (2) the Y-axis defined by the slideway 81 which allows the headstock and tailstock and workpiece to be indexed relative to the wheel 46. X and Y are normally orthogonal.

In accordance with the invention the camshaft workpiece is supported at the near end by a headstock (not shown in FIG. 5) and at journal bearing regions along the length between pairs of jaws 84, 86 which can be opened by pivoting the upper jaws 86 relative to the lower to allow the mounting and demounting crankshafts.

The drive for imparting pivotal movement to the upper jaws 86 is shown in FIG. 5, and comprises a hydraulic rotary actuator 88 driving a splined shaft 90. The shaft 90 defines the pivot axis of the upper jaws 86 which are splined thereto so that rotation of 90 produces similar rotational movement of all of the upper jaws 86. Control of the actuator 88 is from an overall control system (not shown) of the grinding machine, so that clockwise rotation to open the jaws 86 automatically occurs at the completion of a grinding operation, and anticlockwise rotation to close the jaws occurs after a fresh crankshaft has been inserted, prior to the next grinding operation. When the end of the crankshaft remote from the headstock is to be supported in a tailstock, the latter is arranged to advance into engagement with and retract from the crankshaft end as appropriate.

FIG. 6 shows a modified form of actuator comprising an arm 88A which is replicated one for each upper jaw 86, along the array. The arms 88A are all freely pivotable as are the jaws 86 about an axis 89 and the arms 88A are pivoted by a rod 91 which extends through aligned oversize openings in the above as at 93. Each arm is joined to a bracket 95 on the side face of its associated upper jaw 86 through a spring 97. This isolates the upper jaws from one another and effectively decouples each of the supports along the array.

Figure 7:
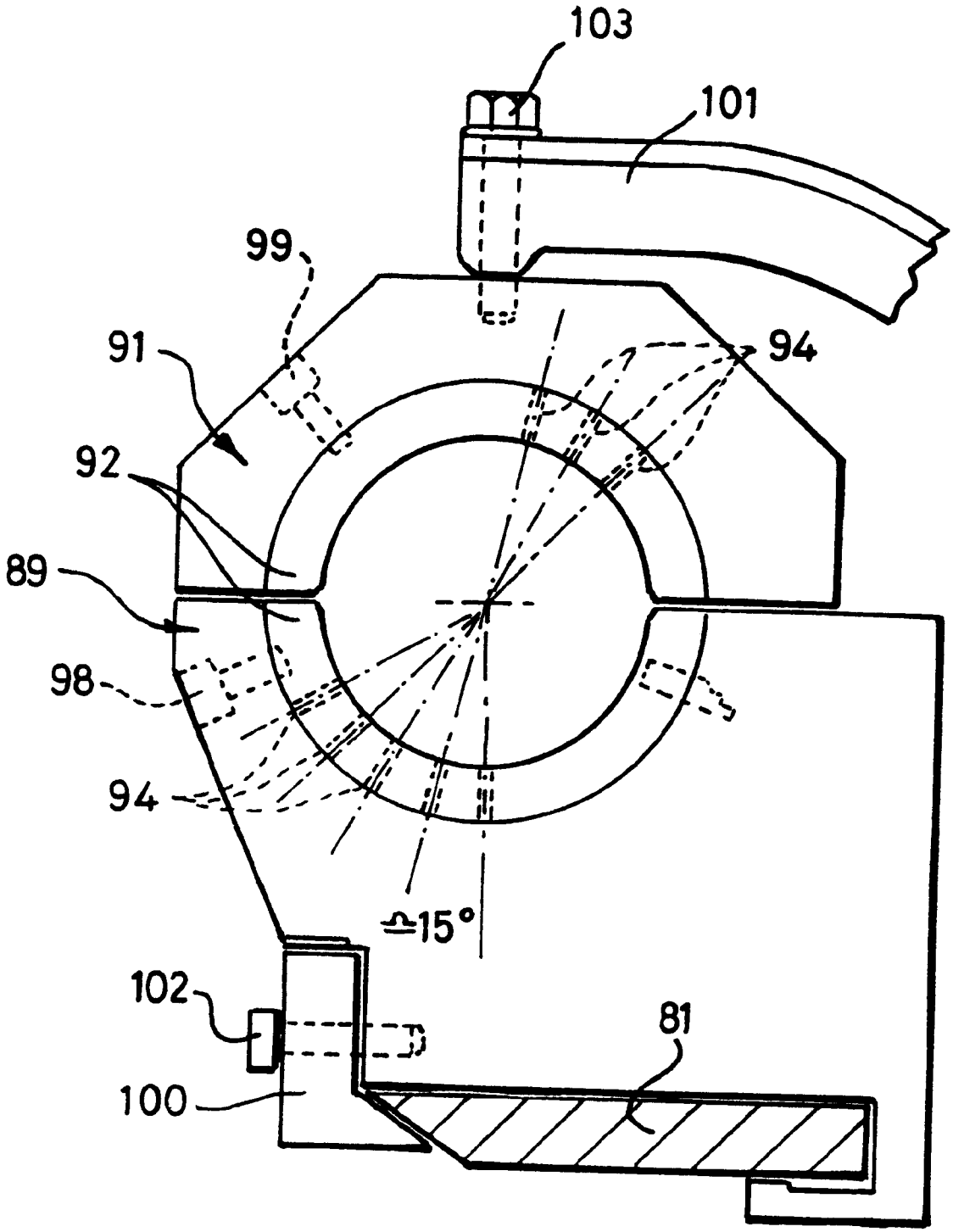
FIG. 7 is an end view of another support member embodiment, showing some of the passages for supplying some of the ports.

Another arrangement is shown in FIG. 7. Here each jaw 89, 91 includes a liner 92 made of hardened steel, in which are formed radially extending ports 94, spaced apart at approximately 15° intervals. The ports open into the bearing surfaces in recesses 96, approximately 0.12 mm (0.005 in.) in depth. These recesses may be square (as shown at 96 in FIG. 6) or may be circular as shown at 96A in FIG. 6.

Oil, such as that used as the coolant for the grinding wheel, is fed to an inlet 98 in each lower jaw 89 and passes to the ports 94 via an annular passage which may be a groove (not shown) formed between the liner 92 and the jaw. The oil is supplied at a pressure of approximately 200 p.s.i. (130N/$cm^2$). With a typical crankpin of 60 mm diameter clamped between a pair of jaws, this results in a total retaining force of approximately 750 lb (3,300N) between a pair of jaws. A similar inlet 99 provides for the supply of oil to the ports in the upper jaw 91.

The lower jaw 89 is locked in position on the slideway 81. To this end a locking member 100 is clamped to the edge of the slideway 81 by means of a threaded bolt 102 which passes through the member 100 and is engaged in a correspondingly threaded hole in the lower jaw 89.

FIG. 7 also shows an alternative arrangement for supporting and moving the upper jaws 91. This comprises an arm 101 secured to the upper jaw 91 by a screw 103. The arm is pivotally mounted at its opposite end and a drive therefor allows the arm and the jaw 89 to be pivoted into and out of the position shown in FIG. 7.

As an alternative to the use of grinding wheel coolant for lubricating the journal bearings formed by the pairs of jaws, air may instead be supplied under pressure to the ports 94 in the surfaces of the jaw, to form air bearings. The ports are altered where appropriate to more efficiently create the air cushion.

One advantage of the use of an air bearing is that the airflow across the land between adjacent pairs of ports helps to purge particles of debris which may ingress during the grinding process. This further assists in reducing friction during rotation of the crankshaft, thereby reducing any twist due to torsion in the crankshaft during grinding.

Figure 8:
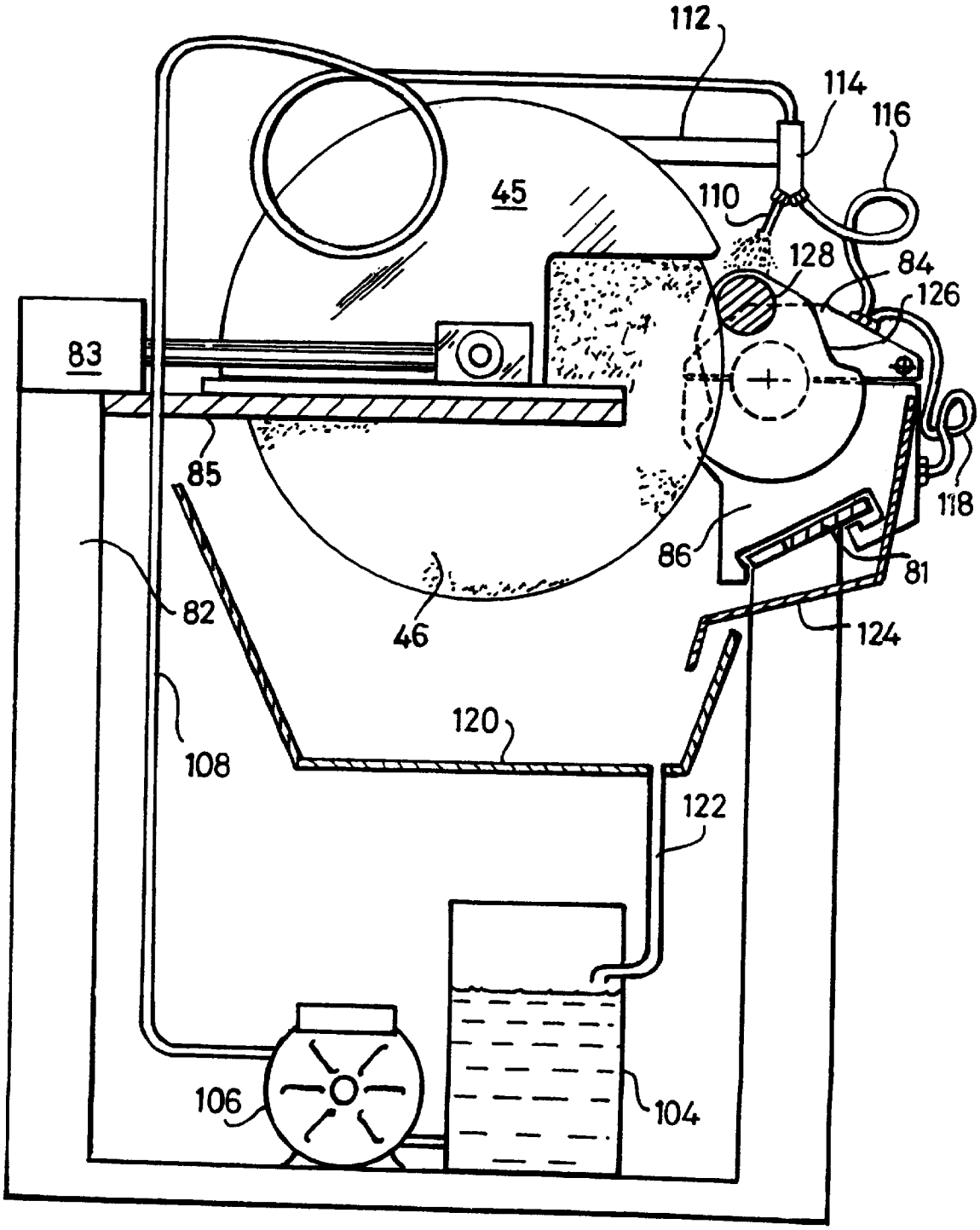
FIG. 8 is a side elevation partly in section, showing the position of different parts of a grinding machine incorporating a workpiece support in accordance with the invention.

FIG. 8 shows inter alia, how coolant liquid can be supplied to the support bearings formed by the pairs of jaws 84, 86 of FIG. 5.

The coolant is stored in a tank 104 located within the body of the machine and is pumped therefrom by a rotary pump 106 through a pipeline 108 to a spray nozzle 110 carried at the end of a bracket 112 attached to the wheel cover 45 and extending forward therefrom.

The bracket carries a manifold 114 to which the pipe 108 and the nozzle 110 are connected and drillings in the manifold convey the coolant liquid from the pipe to the nozzle.

Also connected to the manifold to receive coolant liquid therefrom is a flexible hose 116 which leads to an inlet port (not shown) in an end of the series of jaws 84, and further pipes (not shown) convey liquid from one jaw to the next by means of outlet and inlet ports. Within each jaw 84 drillings convey coolant liquid to ports (not shown in FIG. 8 but similar to those shown at 94 in FIG. 6) in the curved surfaces of the lower jaws 84, and further hoses 118 are provided to convey coolant liquid from the lower jaw 84 to the upper jaw 86 of each pair, for feeding ports (not shown) in the curved surface of the upper jaw 86, so as to produce a hydrostatic bearing for the workpiece section which is rotatable within the pair of jaws 84, 86.

Since the pressure of liquid needed to form the hydrostatic bearings may be greater than that normally handled by the nozzle 110, the manifold 114 may include a flow and pressure restrictor in the feed to the nozzle 110. Furthermore, since it may be desirable to remove the supply of liquid from the hose 116 without interrupting the flow of liquid to the nozzle, remotely controlled valve means may be provided (not shown) in the manifold feed to the line 116, and control signals therefor are derived from the control system for the machine, as are control signals for the pump 106 and supply valves and bypass valves associated with the pipe 108.

Pressure excesses when flow is inhibited can be prevented by incorporating a pressure relieved bypass valve in association with the pump.

Below the wheelhead is located a coolant collection tray 120 which is positioned and dimensioned so as to optimise the recovery of coolant deflected from the wheel and the workpiece (in known manner), and a drain pipe 122 returns collected coolant to the tank 104.

A second collection tray 124 is located below the workpiece to collect coolant which is forced out from between the jaws and the workpiece sections rotating therein.

The tray 124 may be segmented as to fit between the lower jaws 86.

For completeness part of a crankshaft workpiece 126 is shown as it might appear at one point during its rotation in the jaws, with the grinding wheel 46 engaging and grinding one of the crankpins 128. In accord with known practice, the wheelhead is advanced and retracted along the X-axis in synchronism with the rotation of the crankshaft workpiece 126, so that working engagement between the wheel 46 and crankpin 128 is maintained at all times during the rotation of the crankshaft. Control signals for the X-axis drive 83 may also be obtained from the central control system provided for the machine, and where a vernier scale is provided with a reading head (or other movement sensory means) and position information from the reading head indicates movement of the wheelhead along the X-axis, this information may also be supplied to the central control system together with similar position information from scale and reading head means (not shown), associated with movement along the Z-axis, of the workpiece and its support/drive assembly, ie the assembly of headstock, workpiece, tailstock and the support jaws provided by the invention).

What is claimed is:

1. A method of supporting a workpiece having crankpins and journal regions, in a grinding machine for grinding the crankpins while the workpiece rotates about a main axis thereof which passes through the journal regions, comprising the steps of:

i) mounting the workpiece in a headstock of the grinding machine, ii) coupling the workpiece to a rotary drive mechanism for rotating the workpiece about its main axis, and iii) fitting a pair of members around a journal region of the crankshaft at a position remote from the headstock, the pair of members cooperating to form at least part of at least one journal bearing complementary to the journal region, and iv) supporting at least one of the pair of members, thereby in turn providing a remote support for the crankshaft at the said position remote from the headstock, v) wherein the remote support is provided by a plurality of said at least one journal bearing, each situated at and surrounding a respective journal region of the crankshaft.

2. A method according to claim 1, in which a lower one of the pair of members of each complementary journal bearing is movable into a position in which it is aligned with the crankshaft, and includes an upwardly open curved surface forming a cradle which is of complementary radius to, and in its aligned position cradles an underside of, a journal region of the crankshaft when the latter is fitted to the headstock.

3. A method according to claim 2, in which the upper member of each complementary journal bearing comprises a closure which is movable between an open position to allow for insertion and removal of a crankshaft, and a closed position, in which each upper member bridges its respective cradle so as to restrain movement of the crankshaft in an upward sense out of the cradle provided by the lower member.

4. A method according to claim 3, in which each closure for bridging a cradle comprises a finger which when urged towards the crankshaft provides a reaction surface to prevent the upward movement of the crankshaft.

5. A method according to claim 3, in which each closure includes a downwardly facing curved surface complementary to, and adapted to co-operate with its respective upwardly curved surface to form at least part of a two part journal bearing around a journal region of the crankshaft, and the method includes the step of moving each closure into contact with the crankshaft, so that the complementary two curved surfaces encircle a journal region and provide a substantially uniform restraint around the circumference thereof.

6. A method according to claim 5, further comprising the step of grinding the crankpins, after which each closure is raised into its open position so as to be clear of the crankshaft, to permit the latter to be removed, and replaced by a further crankshaft ready for grinding.

7. A method according to claim 6, in which, during the grinding of the crankpins, the closure is secured to its respective cradle and the method further comprises the step of releasing the closure from its respective cradle after grinding.

8. A method according to claim 5, further comprising the step of forcing fluid between at least cradle support surface and the respective journal regions of the crankshaft, during rotation thereof.

9. A method according to claim 8, in which the fluid is a gas or mixture of gases.

10. A method according to claim 8, in which both cradle and closure curved surfaces are apertured and a hydrostatic bearing is formed with the crankshaft when fluid is pumped between the two bearing surfaces and the crankshaft.

11. A method according to claim 10, in which the hydrostatic force generated by the liquid is sufficient to centre each journal region of the crankshaft so as to minimise the effect of any deformities or misalignment of or surface irregularities in each curved surface of the cradle and closure.

12. A method according to claim 8, in which the fluid is a liquid.

13. A method according to claim 12, in which the liquid is oil based.

14. A method according to claim 13, wherein the liquid comprises a coolant oil to cool the grinding wheel and workpiece during grinding.

15. A method according to claim 12, wherein liquid which escapes from between the cradle and closure surfaces is recovered, cleaned and recycled.

16. A method according to claim 1 wherein the end of the workpiece remote from the headstock is additionally supported by means of a tailstock.

17. Crankshaft supporting apparatus in combination with a crankshaft for use in a grinding machine for supporting the crankshaft for grinding the crankpins thereof, in which the crankshaft has journal regions and is carried at one end by a headstock and is rotatable by drive means about a main axis thereof which passes through the journal regions, said support apparatus comprising at least one two part combination at least one part of which is securable to the machine, and which two parts are fitted around and at least in part encircle at least one of the journal regions of the crankshaft, to provide support therefor remote from the headstock.

18. Crankshaft supporting apparatus in combination with a crankshaft and a grinding machine for grinding crankpins of the crankshaft having coaxial journal regions disposed between the crankpins, comprising:

i) a machine bed;

ii) headstock means mounted on the bed for rotating a crankshaft when fitted thereto about an axis passing through said journal regions, hereinafter referred to as the main axis of the crankshaft;

iii) a grinding wheel mounted on a wheelhead assembly;

iv) drive means for moving the wheelhead assembly towards and away from the crankshaft;

v) drive means for rotating the crankshaft about its said main axis, and vi) two-part cradle means mounted in the machine, at least one part of which includes at least an upwardly directed curved support surface which engages an underside of a journal bearing region of the crankshaft when fitted to the headstock.

19. Apparatus according to claim 18, in which the other part of the cradle means cooperates with the said one part to circumferentially encircle the journal bearing region of the crankshaft, and the two parts are movable relatively away from one another, to permit their separation to allow the crankshaft to be inserted or removed, and are likewise movable relatively towards each other to circumscribe the journal region, when inserted therebetween.

20. Apparatus according to claim 19, in which there are a plurality of said two part cradle means axially spaced along a camshaft-occupying region of the machine, so as to align with, and provide full circumferential support to, a corresponding plurality of journal regions of the crankshaft.

21. Apparatus according to claim 18, in which each cradle means includes first ports through which liquid can be supplied, to form a liquid film between the crankshaft and each curved support surface of the cradle means.

22. Apparatus according to claim 21, in which the first ports communicate with a system for supplying liquid under pressure thereto during use, such that the liquid forms a hydrostatic bearing film between the curved support surfaces of the cradle means and the crankshaft and the grinding machine includes a fluid collection system to recover fluid which escapes therefrom during rotation of the crankshaft during grinding.

23. Apparatus according to claim 21, wherein each journal region of the crankshaft also includes second ports for lubricating oil for when it is mounted in an engine block, and spacing and positioning of the first ports in the curved surfaces of the cradle means is selected so that at no time will pairs of first ports in the cradle means coincide with pairs of second ports in the crankshaft as the latter rotates, so that the second ports do not interfere with the establishment of the film of liquid.

24. Apparatus according to claim 18, in which each cradle means comprises a lower member aligned with the crankshaft-occupying region of the machine and fixed relative to said machine bed, having a semi-cylindrical recess formed therein for embracing the lower half of a journal region of the crankshaft, and an upper member which is adapted to engage the upper half of the journal region in general alignment with the lower member, the upper member being movable away from the lower member, to allow the crankshaft to be placed in and removed from the lower member, and movable towards and adapted to be clamped to, the lower member, to encircle the journal region.

25. Apparatus according to claim 24, in which the upper member is also formed with a semi-cylindrical recess to embrace the upper half of the journal region of the crankshaft when fitted, and the upper and lower members are adapted to be secured together, as by clamping, to form a continuous sleeve around the journal region.

26. Apparatus according to claim 24, further comprising drive means for effecting the said movement of the upper member, which drive means is, in use, controlled by an overall control system linked to or forming part of the machine, so that the two members of each cradle means are separated when grinding is completed to allow the finished crankshaft to be removed and a fresh one to be inserted, and are automatically closed so as to circumscribe the journal region of a new crankshaft, after insertion, before grinding commences.

27. Apparatus according to claim 26 when, in which the drive means comprises a common shaft connected to the respective upper member of each cradle means, wherein rotation of the said common shaft causes simultaneous movement of all of the said upper members.

28. Apparatus according to claim 27, in which the said common shaft extends through the said upper members and carries splines engageable with respective correspondingly splined bores in the said upper members.

29. Apparatus according to claim 27, in which the drive means for rotating the shaft comprises a rotary hydraulic cylinder or electric motor.

30. Apparatus according to claim 18, in which each cradle means is slidable relative to the machine bed and includes clamping means for clamping the cradle means thereto.

31. Apparatus as claimed in claim 18, further including a tailstock for supporting an end of the crankshaft remote from that which is fitted in the headstock.

32. A cradle cradle assembly in combination with a crankshaft for supporting a cylindrical journal region of the crankshaft while the latter is being machined, comprising a lower part secured to a fixed part of a machine and shaped to receive the lower half of the said region, and an upper part movable toward the lower part to enclose and capture the region before and during machining, and movable away from said lower part to enable the crankshaft when machined to be removed and a new crankshaft to be inserted.

* * * * *